US005575635A

United States Patent [19]

Yamamoto et al.

[11] Patent Number: 5,575,635

[45] Date of Patent: Nov. 19, 1996

[54] SCROLL COMPRESSOR HAVING ECCENTRIC SHAFT LUBRICATION

[75] Inventors: Yuuji Yamamoto, Toyota; Shinichi Watanabe, Nagoya; Tsuyoshi Takemoto, Aichi; Shigeru Hisanaga, Kariya; Tetsuhiko Hukanuma, Kariya; Shinya Yamamoto, Kariya, all of Japan

[73] Assignees: Nippondenso Co., Ltd.; Kabushiki Kaisha Toyoda Jidoshokki Seisakusho, both of Japan

[21] Appl. No.: 404,828

[22] Filed: Mar. 15, 1995

[30] Foreign Application Priority Data

Mar. 15, 1994 [JP] Japan ..... 6-044352
May 24, 1994 [JP] Japan ..... 6-109978

[51] Int. Cl.[6] ..... F04C 18/04; F04C 29/02

[52] U.S. Cl. ..... 418/55.5; 418/55.6; 418/100

[58] Field of Search ..... 418/55.5, 55.6, 418/57, 94, 100

[56] References Cited

U.S. PATENT DOCUMENTS

| | | | |
|---|---|---|---|
| 4,332,535 | 6/1982 | Terauchi et al. | 418/94 |
| 4,457,675 | 7/1984 | Inagaki et al. | 418/55.5 |
| 5,011,384 | 4/1991 | Grunwald et al. | 418/55.5 |
| 5,120,205 | 6/1992 | Ban et al. | 418/55.1 |
| 5,201,646 | 4/1993 | Dees et al. | 418/55.5 |
| 5,308,231 | 5/1994 | Bookbinder et al. | 418/55.6 |
| 5,366,357 | 11/1994 | Fukanuma et al. | 418/55.6 |
| 5,437,543 | 8/1995 | Goto et al. | 418/55.5 |
| 5,452,995 | 9/1995 | Izumi et al. | 418/55.5 |
| 5,456,584 | 10/1995 | Isomura et al. | 418/55.1 |

FOREIGN PATENT DOCUMENTS

| | | |
|---|---|---|
| 0426206 | 5/1991 | European Pat. Off. . |
| 0475538 | 3/1992 | European Pat. Off. . |
| 0643224 | 3/1995 | European Pat. Off. . |
| 0652371 | 5/1995 | European Pat. Off. . |
| 4338771 | 5/1994 | Germany . |
| 4339203 | 5/1994 | Germany . |
| 4340269 | 6/1994 | Germany . |
| 2-176179 | 7/1990 | Japan . |

*Primary Examiner*—John J. Vrablik
*Attorney, Agent, or Firm*—Cushman Darby & Cushman, LLP

[57] ABSTRACT

An eccentric shaft 5 is radially slidably inserted in a bore 6*a* of a bushing 6, which is inserted in an opening 8*c*-1 of a boss portion 8*c* of a movable scroll member 8 by way of a radial needle bearing 7. An axial space 24 is confined between a rear end of a bushing 6 and a bottom surface of the opening 8*c*-1. The space 24 is in communication with the radial bearing 7 via an annular gap 26 between faced surfaces of bushing 6 and the opening 8*c*-1. A radial space 23 is confined between the inner surface of the bore 6*a* and the eccentric shaft 5, so that a limited radial movement of the eccentric shaft 5 with respect to the bushing 6 is allowed. A washer 21 for obtaining a fixed axial location of the bushing 6 on the eccentric shaft 5 is formed with recess 21*b* (first passageway 25) for communicating the radial space 23 with the axial space 24. The bushing 6 is further formed with a radial hole 27 (second passageway) for communicating the radial space 23 with a crank chamber R. A recirculation passageway for the lubricant is thus generated between the crank chamber R, the gaps in the needle bearing 7, the gap 26, the axial chamber 24, the first passageway 25, the radial space 23, the second passageway 27 and the crank chamber R.

7 Claims, 12 Drawing Sheets

SCROLL COMPRESSOR HAVING ECCENTRIC SHAFT LUBRICATION

BACKGROUND OF THE INVENTION

1. Field of the Invention

The present invention relates to a scroll compressor suitable for use in an air conditioning device for an automobile.

2. Description of Related Art

Known in a prior art is a scroll compressor having a center housing in which stationary and movable scroll members are arranged so that compression chambers are formed between the scroll members. A front housing is connected to the center housing. A rotating shaft has a large diameter portion which is rotatably supported in the front housing by means of a radial bearing. An eccentric shaft is fixedly connected to an inner end of the rotating shaft, on which eccentric shaft a movable scroll member is rotatably supported by way of the bushing 6 and a second radial bearing. Furthermore, a mechanism for blocking self-rotation of the movable scroll member is arranged between the front housing and the movable scroll member, so that self-rotation of the movable scroll member about its own axis does not occur. A rotation of the rotating shaft causes the eccentric shaft, which is eccentric to the shaft, to be rotated about the axis of the shaft. Thus, the movable scroll member rotatably supported on the bushing effects an orbital movement about the axis of the shaft, so that the compression chambers are moved radially inwardly, while the volume of the chambers is reduced, thereby compressing the gas in the compression chambers. During the orbital movement, a relative radial movement of the eccentric shaft with respect to the bushing is allowed due to the compression reaction force, thereby obtaining a desired radial contact force between the movable scroll member and the stationary scroll member.

In the prior art scroll compressor, in order to prevent the bushing from being withdrawn from the eccentric shaft, while allowing a relative radial movement between the bushing and the eccentric shaft, a washer is inserted to the eccentric shaft from its free end remote from the large diameter portion of the shaft, and a snap ring is fitted to the shaft and engaged with a groove formed on the eccentric shaft. However, by this construction, an outwardly closed space is created between the eccentric shaft and the bushing. Thus, the lubrication of the sliding portion between the eccentric shaft and the bushing relies only to the lubricant held in the space. Thus, the lubrication of the sliding surfaces is likely to be insufficient.

SUMMARY OF THE INVENTION

An object of the present invention is to provide a scroll compressor capable of overcoming the above mentioned drawbacks in the prior art.

Another object of the present invention is to provide a scroll compressor capable of increasing the lubrication performance in the radial sliding surfaces between the eccentric shaft and the bushing.

According to the present invention, a scroll compressor for a gas including lubricant is provided, comprising:

a housing;

a drive shaft having an axis of rotation, the drive shaft having a first portion of a small diameter and a second portion of a large diameter;

a first radial bearing for rotatably supporting the drive shaft with respect to the housing;

a stationary scroll member which is in a fixed relationship with respect to the housing;

a movable scroll member arranged eccentric with respect to the stationary scroll member so that a plurality of compression chambers are created between the scroll members;

an eccentric shaft connected to the drive shaft and eccentric with respect to the drive shaft;

a bushing having a bore of a substantially rectangular cross sectional shape, to which the eccentric shaft is inserted and is located on a fixed position, while the rotational movement of the shaft is transmitted to the bushing and a boss portion at a side opposite to the compression chambers;

a second radial bearing housed in the boss portion of the movable scroll member for rotatably supporting the bushing with respect to the movable scroll member;

an axial space being formed between faced ends of the bushing and the boss portion, so that the space is in communication with the second radial bearing;

a self rotation blockage mechanism, for the movable scroll member, which prevents the movable scroll member from being rotated about it own axis, so that the orbital movement of the movable scroll member allows the compression chambers to be moved radially from an outward position to an inward position;

an intake means for introducing the gas to be compressed into a compression chamber when it is located at a radially outward position;

an outlet means for discharging the gas as compressed when the compression chamber is located at a radially inward position;

the bore of the bushing defining spaced first inner surfaces, while the eccentric shaft defines spaced first outer surfaces, so that the inner surfaces contact with faced outer surfaces, which allows the rotating movement of the eccentric shaft to be transmitted to the bushing;

the bore further defining spaced second inner surfaces, while the eccentric shaft defines spaced second outer surfaces, so that radially confined spaces are created between faced second inner and outer surfaces, which allows the bushing along said contacted first inner and outer surfaces to be relatively radially moved and;

a first passageway for obtaining communication between the radially confined spaces with said axially confined space, thereby obtaining transmission of a lubricant between the spaces.

BRIEF DESCRIPTION OF ATTACHED DRAWINGS

DESCRIPTION OF PREFERRED EMBODIMENTS

Figure 1:
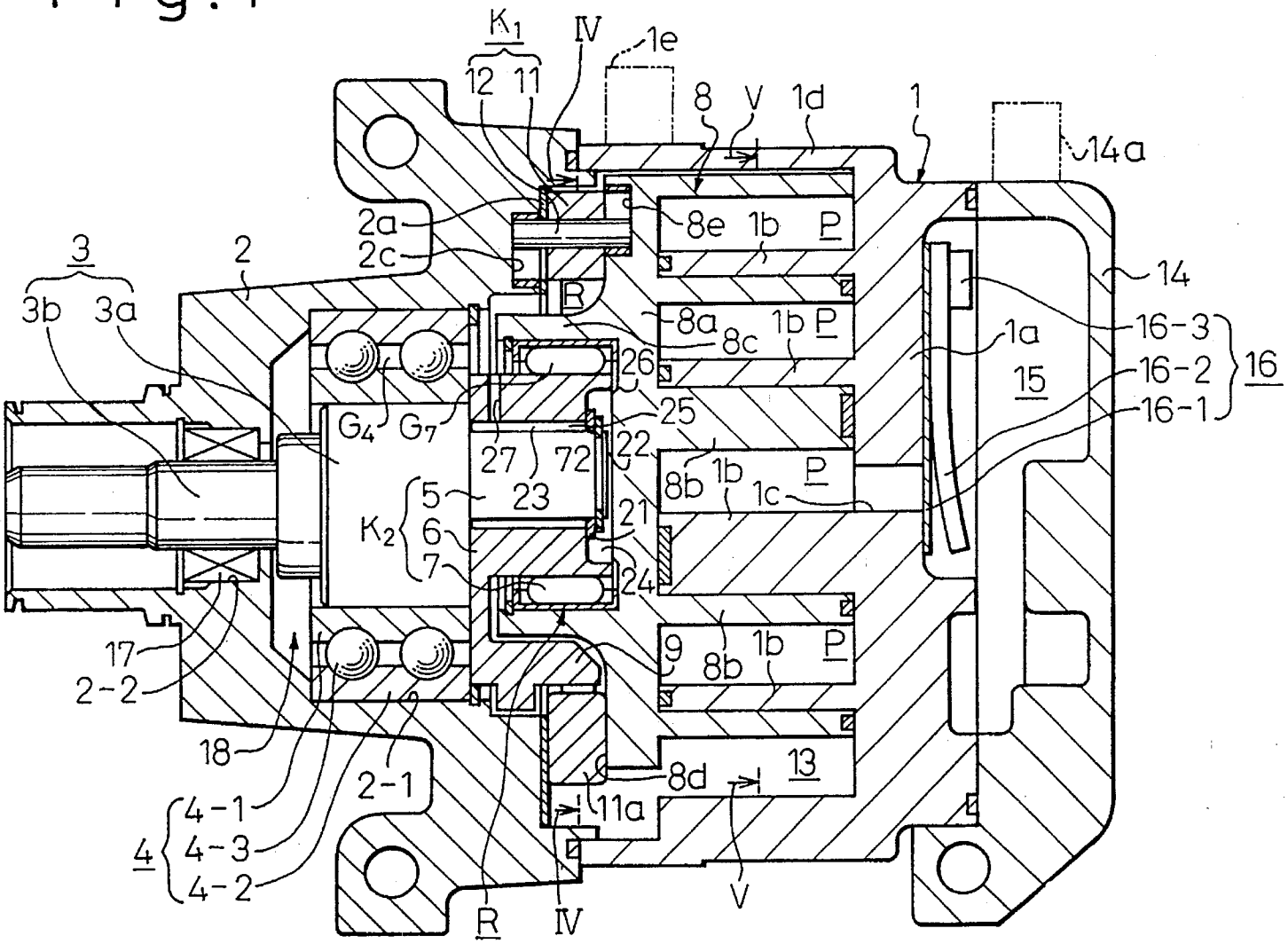
FIG. 1 is a longitudinal cross-sectional view of the scroll compressor according to the present invention.

Now, embodiments of the present invention will be explained with reference to attached drawings.

In FIGS. 1 to 5, illustrating a first embodiment of the present invention, a reference numeral 1 denotes a stationary scroll member, which is integrally formed with a center housing 1*d*, to which a front housing 2 is fixedly connected by suitable means such as bolts and nuts. A movable scroll member 8 is movably arranged in the housing. A reference numeral 3 denotes a rotating (or drive) shaft, which is formed with a large diameter portion 3*a* and a small diameter portion 3*b* extending integrally from the large diameter portion 3*a*.

The front housing 2 is formed with a boss portion in which axial openings 2-1 and 2-2 are formed. The large diameter portion 3*a* of the drive shaft 3 is inserted to the opening 2-1 of the front housing 2 via a first radial bearing unit as a ball bearing unit 4.

The movable scroll member 8 is further provided with a tubular boss portion 8*c* extending integrally from the end of the base plate 8*a* remote from the scroll portion 8*b*.

Figure 3:
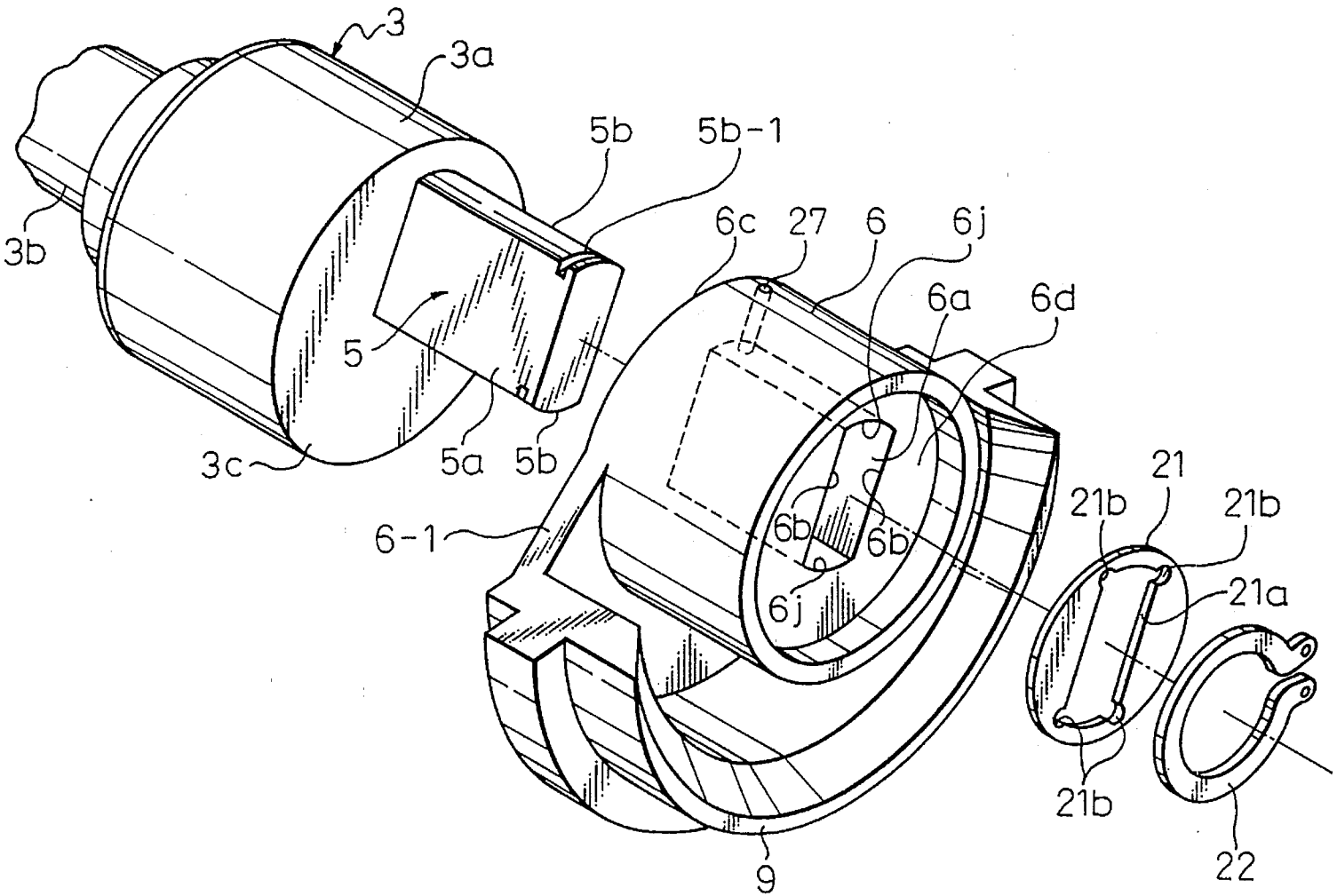
FIG. 3 is a dismantled perspective view illustrating a construction of the crank mechanism.

A crank mechanism $K_2$ is provided for obtaining an orbital movement of the movable scroll member 8 with respect to the stationary scroll member 1. The crank mechanism $K_2$ is constructed of an eccentric shaft 5, a bushing 6, and a second radial bearing 7 as a needle bearing unit. The eccentric shaft 5 is integral with respect to the shaft 3 and extends from the large diameter portion 3*a* opposite to the small diameter portion 3*b* as shown in FIG. 3. Namely, the eccentric shaft 5 is under an eccentric arrangement with respect to the rotating shaft 3. As shown in FIG. 3, the drive shaft 5 forms a pillar of a substantially rectangular cross sectional shape. Namely, the shaft 5 has outer surfaces 5*a* spaced in parallel and outer rounded surfaces 5*b* connecting the surfaces 5*a* with each other. The bushing 6 is, as shown in FIG. 3, formed with a bore 6*a* of a rounded rectangular cross-section shape, which corresponds to the shape of the eccentric shaft 5. Namely, the bore 6*a* has inner surfaces 6*b* spaced in parallel and inner surfaces 6*j* connecting the surfaces 6*b* with each other. As a result, the eccentric shaft 5 is radially slidably inserted to the bore 6*a* of the bushing 6, while a rotating movement of the rotating shaft 3 is transmitted to the bushing 6, due to the fact that outer parallel surfaces 5*a* of the eccentric shaft 5 engages the inner parallel surfaces 6*b* of the bore 6*a*. See, also, FIG. 4.

Figure 5:
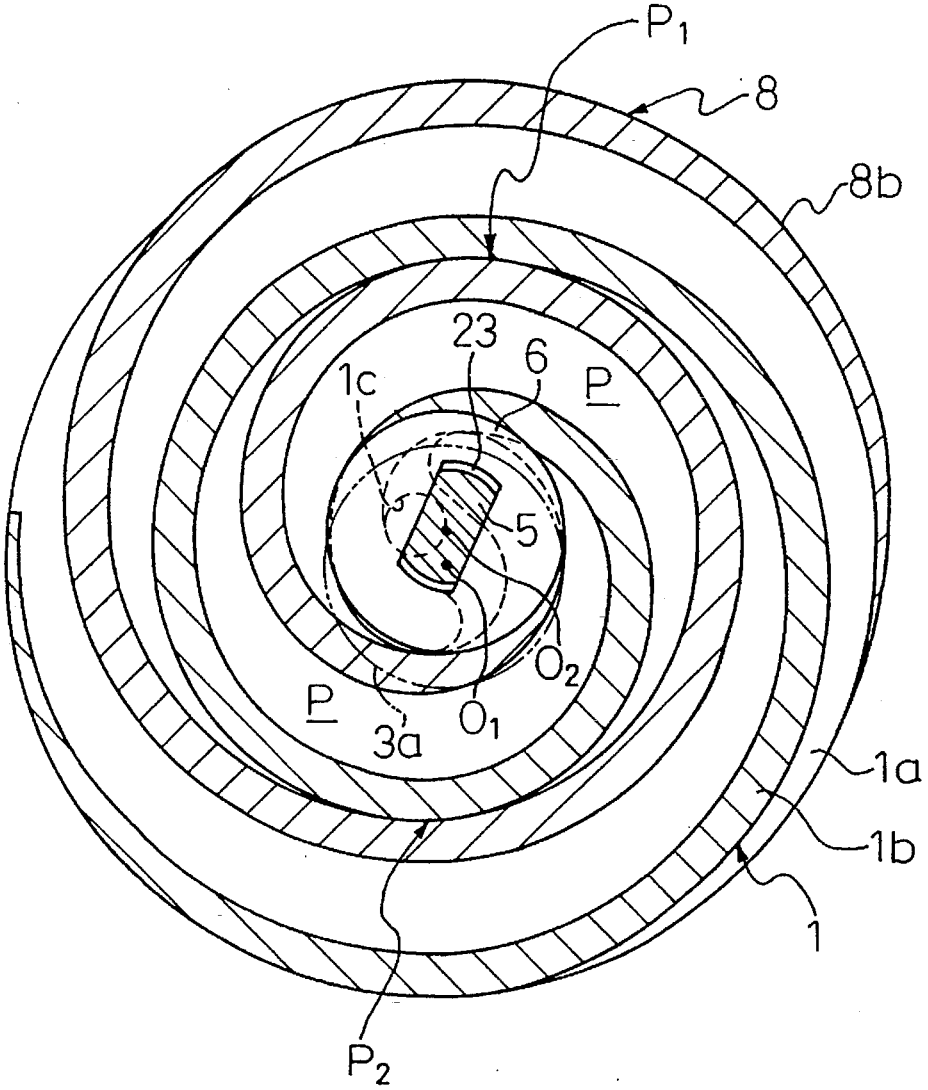
FIG. 5 is a cross sectional view taken along line V—V in FIG. 1.

The movable scroll member 8 is arranged eccentric with respect to the stationary scroll member 1. The stationary scroll member 1 is, as shown in FIG. 1, constructed of a based plate portion 1*a* and a scroll portion 1*b* extending axially integrally from the base plate 1*a*. The movable scroll member 8 is also constructed of a base plate 8*a* and a scroll portion 8*b* extending integrally from the base plate 8*a*. The arrangement of the stationary and movable scroll members 1 and 8 is such that the scroll portions 1*b* and 8*b* are under a radially contacted relationship, while an axial end of the scroll portion 1*b* of the stationary scroll member contacts with the base plate 8*a* of the movable scroll member, and an axial end of the scroll portion 8*b* of the movable scroll member contacts with the base plate 1*a* of the stationary scroll member. As a result, as is well known and as shown in FIG. 5, a plurality of radially spaced compression chambers P are formed between the stationary and movable scroll members 1 and 8.

Figure 2:
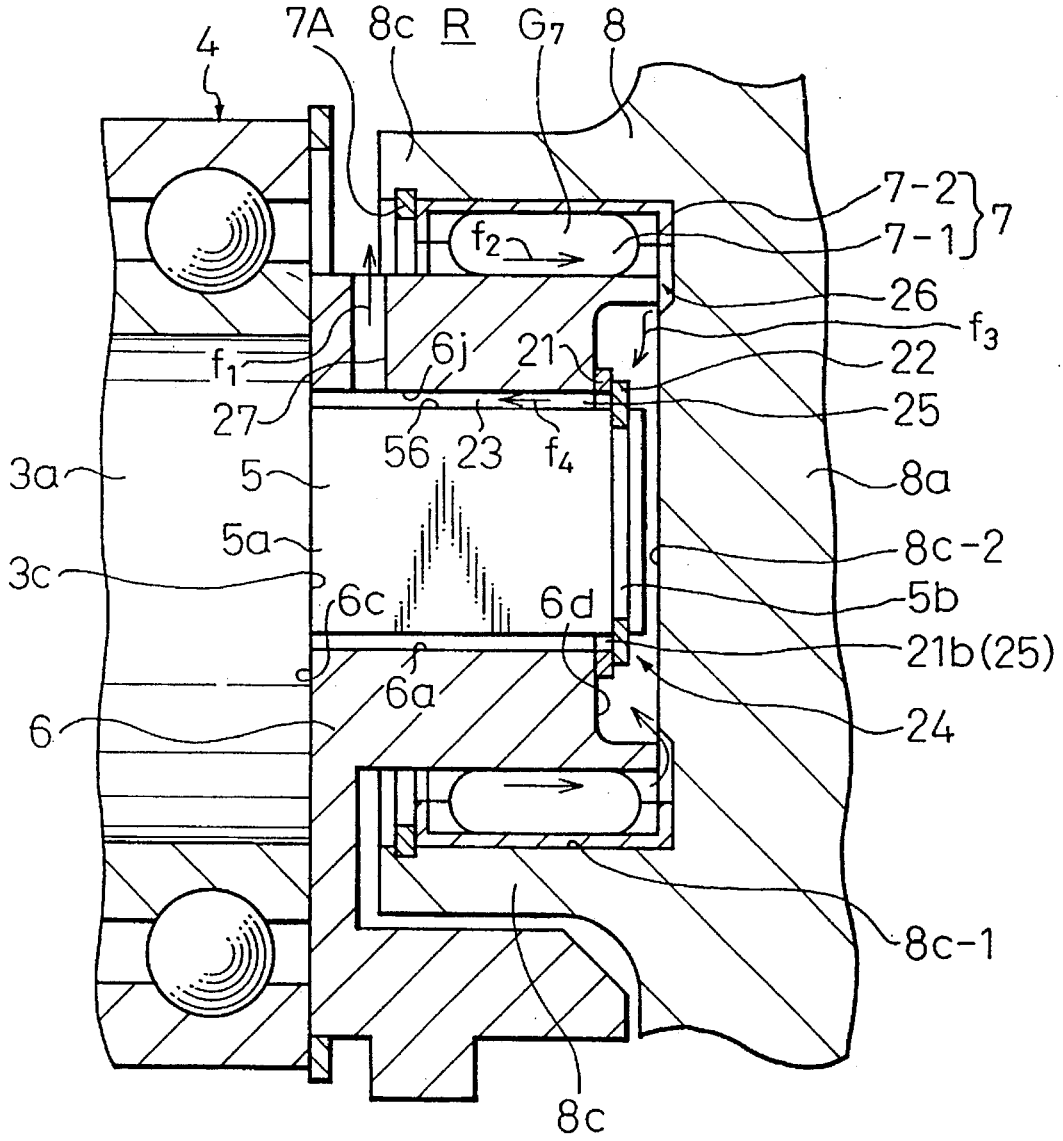
FIG. 2 is an enlarged view of a portion in FIG. 1 for illustrating a recirculated flow of a gas in a crank mechanism.

In FIG. 1, the bushing 6 is inserted to the tubular boss portion 8*c* via the needle bearing unit 7, so that the movable scroll member 8 is rotatably supported on the bushing 6. Namely, the boss portion 8*c* is formed with an axial opening 8*c*-1 (FIG. 2), while the needle bearing 7 is constructed by a plurality of circumferentially spaced needles 7-1 and a casing 7-2 for storing the needles 7-1. The casing 7-2 is fitted to the opening 8*c*-1, and a snap ring 7A is fitted to an annular groove on an inner cylindrical wall of the opening 8*c*-1 for obtaining a fixed position of the needle bearing unit 7. As shown in FIG. 2, an arrangement of the bushing 6 on the end of the eccentric shaft 5 in the opening 8*c*-1 of the boss portion 8*c* creates a space 24, which is confined between a rear surface of the eccentric shaft 5 and an inner axial bottom surface of the recess 8*c*-2.

A rotating movement of the shaft 3 causes the movable scroll member 8 to effect an orbital movement about the axis of the shaft 3, due to the fact that the eccentric drive shaft 5 is in engagement with the bore 6*a* of the bushing 6. As a result of the orbital movement of the movable scroll member, a compression chamber P (FIG. 5) is, as is well known, moved from a radially outward position, where the compression chamber of an increased volume is opened to an inlet of the gas to be compressed, to a radially inward position, where the compression chamber of a decreased volume is opened to an outlet 1*c* of the compressed gas.

In FIG. 3, the bushing 6 is integrally formed with a radially extending bracket 6-1 at a location diametrically opposite to the eccentric shaft 5, on which an arc-shaped balance weight 9 is integrally formed. The arrangement of the balance weight members 9 is for cancelling a dynamic unbalance generated by the orbital movement of the movable scroll member 8, which is eccentric with respect to the axis of the rotating shaft 3.

Figure 4:
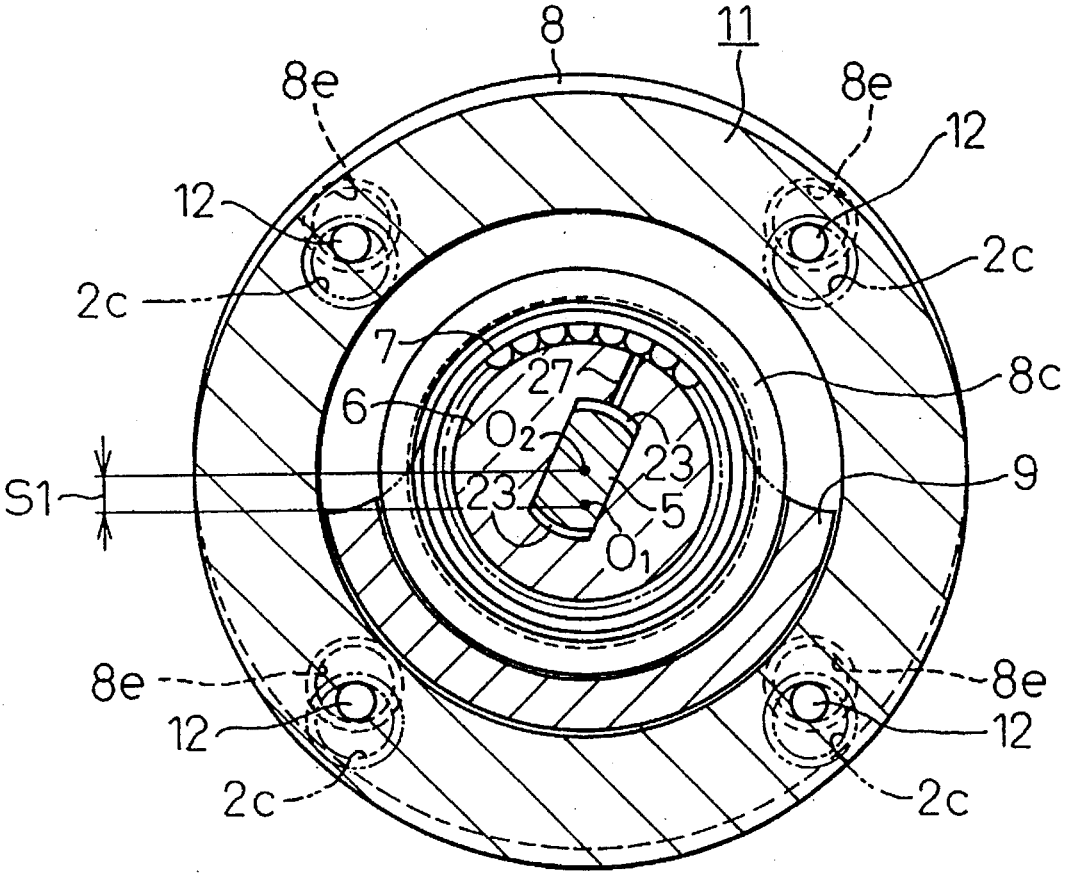
FIG. 4 is a cross sectional view taken along line IV—IV in FIG. 1.

A self rotation blocking mechanism $K_1$ (FIG. 1) is arranged between the surface 8d of the base plate 8*a* of the movable scroll member 8 (a pressure receiving surface on the movable side) remote from the scroll portion 8*b* and the surface 2*a* of the front housing 2 facing the movable scroll member 8 (a pressure receiving surface on the immovable side). The self rotation blocking mechanism $K_1$ is for preventing the movable scroll member 8 from being rotated about its own axis, while allowing the movable scroll member 8 to effect an orbital movement about the axis of the rotating shaft 3. Namely, the self rotation blocking mechanism $K_1$ is constructed of a self rotation blockage ring 11 and a plurality of circumferentially and equiangularly spaced self rotation blocking pins 12, which are freely inserted into corresponding bores in the ring 11. In FIG. 1, the front housing 2 forms, at the pressure receiving surface 2*a* on the immovable side, a predetermined number of circumferentially spaced recesses 2*c*, for example, 4, while the movable scroll member 8 forms, at the pressure receiving surface 8*d* on the movable side, circumferentially and equiangularly spaced recesses 8*e* of an equal of number. In other words, four sets of circumferentially, equiangularly spaced and oppositely faced recesses 2*c* and 8*e* are provided as shown in FIG. 4. The pins 12 are, at their ends, projected out of the ring 11 and are engaged with the recesses 2*c* and 8*e* of the corresponding pairs at their radially opposite surfaces.

Between the locations where the pins 12 are provided, the ring 11 is formed with pressure receiving portions 11*a* (FIG. 1), which are, at their inner and outer surfaces, in contact with the pressure receiving surface 8*d* on the movable side and the pressure receiving surface 2*a* on the immovable side, respectively. As a result, the reaction force generated by the compression in the compression chambers P is transmitted from the surface 8*d* to the surface 2*a* by way of the pressure receiving portions 11*a*.

In the housing, a crank chamber R is delimited inside the ring 11 and between the front housing 2 and the movable scroll member 8. The crank mechanism $K_2$ effects the orbital movement in the crank chamber R.

An intake chamber 13 is formed between the movable scroll member and an inner peripheral wall of the center housing 1*d*. As shown in FIG. 1, the center housing 1*d* is formed with an intake port 1*e* opened to an outside source (an evaporator in a refrigerating system) of the gas to be compressed, on one hand and the intake chamber 13, on the other hand, so that the refrigerant gas from the source is introduced into the intake chamber 13. The gas in the intake chamber 13 is mainly subjected to the compression in the compression chambers P. However, as will be described in detailed, the gas in the intake chamber 13 is partly introduced into the crank chamber R via gaps in the self-rotation blockage mechanism K.

A rear housing 14 is connected to the rear end of the stationary scroll member 1, so that an outlet chamber 15 is created between the base plate 1*a* of the stationary scroll member 1 and the rear housing 14. An outlet valve 16, arranged in the outlet chamber 15, includes a reed valve 16-1, a stopper plate 16-2, and a bolt 16-3 for connecting one end of the reed valve 16-1 to the base plate 1*a* together with the stopper plate 16-2. The reed valve 16-1 is, due to its resiliency, usually at a position where the outlet port 1*c* is closed. The base plate 1*a* of the stationary scroll member 1 is formed with a tubular flange portion 14*a* which forms an opening opened to the outlet chamber 15. The tubular flange 14*a* is connected to a condenser (not shown) in a refrigerating circuit.

A shaft seal unit 17 is fitted to the bore 2—2 of the front housing 2, and is arranged adjacent the first radial bearing unit 4, so that a shaft seal chamber 18 is formed inside the housing at a location between the shaft seal unit 17 and the first radial bearing unit 4. The first radial bearing unit 4 is constructed by an inner race 4-1, an outer race 4-2 and a plurality of angularly spaced balls 4-3. A gap $G_4$ is created between the inner and outer races 4-1 and 4-2. The gap $G_4$ allows the shaft seal chamber 18 and the crank chamber R to communicate with each other. As a result, the gaseous medium in the crank chamber R is supplied to the shaft seal chamber 18 via the gap $G_4$.

In FIG. 3, the pillar shaped eccentric shaft 5 of a rectangular cross sectional shape, which is radially slidable with respect to the bore 6*a* in the bushing 6 by way of the faced pairs of sliding surfaces 5*a* and 6*b*, is projected out of the bore 6*a*, in such a manner that a front end surface 6*c* of the bushing contacts axially with a rear end surface 3*c* of the large diameter portion 3*a* of the shaft 3, as shown in FIG. 2. To the end of the eccentric shaft 5 projected out of the bore 6*a*, a disk shaped washer 21 having a rectangular opening is inserted, so that the washer 21 contacts axially with the rear end surface 6*d* of the bushing 6. As shown in FIG. 3, the eccentric shaft 5 is, at its rear end projected out of the bore 6*a* of the bushing 6, formed with a pair of radially opposite surfaces 5*b*, on which grooves 5*b*-1 are formed. A circlip 22 is fitted to the grooves 5*b*-1, so that the bushing 6 together with the washer 1 is prevented from being withdrawn from the eccentric shaft 5.

As shown in FIG. 2, a pair of opposite spaces 23 are radially confined between the faced surfaces 5*b* and 6*j* of the eccentric shaft 5 and the bore 6*a*, which allows the eccentric member 5 to radially slide with respect to the bushing 6. Due to such a radial slide movement of the bushing 6 with respect to the eccentric shaft 5, the compression force in the compression chamber P causes the scroll wall 8*b* of the movable scroll member 8 to be radially contacted with the scroll wall 1*b* of the stationary scroll member, thereby obtaining an desired sealing effect between the scroll members 1 and 8. As explained with respect to FIG. 3, the rear end surface 3*c* of the large diameter portion 3*a* of the shaft 3 is in sliding contact with the front end surface 6*c* of the bushing 6, while the rear end surface 6*d* of the bushing 6 is in contact with the washer 21, with which the circlip 22 is in an axially faced contact condition. As a result, some means is necessary for allowing the chambers 23 to be in communication with the crank-chamber R, which may otherwise cause the lubrication to be worsened. In view of this, according to the present invention, as shown in FIG. 3, the washer 21 is, at four corners of the opening 21*a* for inserting the eccentric shaft 5, formed with recess 21*b* which are opened to the chambers 23, as shown in FIG. 2. Furthermore, between the washer 21 and the circlip 22, a small gap is inevitably created, which allows the chambers 23 to be in communication with the axially confined space 24 between the rear end surface 6*d* and a recessed end surface 8*c*-2 of the boss portion 8*c*. A first passageway 25 (FIG. 2) is, thus, created for communicating the radial movement allowing chambers 23 with the space 24. Furthermore, as shown in FIG. 2, between the rear end of the bushing 6 and the faced surface of the recess 8*c*-1, an annular gap 26 is created, which allow the space 24 to be in communication with the crank chamber R via the gap $G_7$ in the needle bearing 7. Furthermore, the bushing 6 is formed with at least one radial opening 27, which has an inner end opened to the radial chamber 23 and an outer end opened to the crank chamber R. As a result, a closed circuit for the gaseous lubricant is created, which is, in order, constructed by the crank chamber R, the gap $G_7$ in the second radial bearing unit 7, the annular gap 26, the space 24, the first communication passageway 25, the radial space 23, the second communication passageway 27, and the crank chamber R.

Now, the operation of the scroll compressor according to the present invention will be explained.

A rotating movement from a rotating movement source, such as an internal combustion engine, is transmitted to the rotating shaft 3, which causes the eccentric shaft 5 as well as the bushing 6 to be rotated about the axis $O_1$ of the shaft 3 as shown in FIG. 4. As a result, the movable scroll member 8 rotatably mounted to the bushing 6 effects an orbital movement about the axis $O_1$ of the shaft 3 of a radius of a distance S1 between the axis $O_1$ and the axis $O_2$ of the bushing 6, while the self rotation blocking mechanism $K_1$ blocks the self rotating movement of the movable scroll member 8 about its own axis $O_2$. Namely, due to an arrangement of plurality (four) of circumferentially spaced pins 12 loosely engaged radially with opposite pairs of recess 2*c* and 8*e*, the pins 12 radially support the movable scroll member 8 at circumferentially spaced locations, thereby preventing the movable scroll member 8 from being rotated about its own axis $O_2$. During the orbital movement of the movable scroll member 8, the ring 10, to which the pins 12 are freely inserted, effects an orbital movement of a radius which is expressed by 2×(R−r) where R is a diameter of the circular recess 2*c* and 8*c* and r is a diameter of the pin 12.

The orbital movement of the movable scroll member 8 causes, first, the intake chamber 13 to be sealed as a compression chamber P, and causes, second, the compression chamber P to be displaced radially inwardly while the volume is reduced. Thus, the gaseous refrigerant introduced, from an evaporator (not shown) in a refrigerating system, into the intake chamber 13 via the intake port 1*e* is subjected to compression in the compression chamber P, and is finally discharged, via the outlet port 1*c*, into the outlet chamber 15 by displacing the reed valve 16-1 against the force of the elasticity of the reed valve 16-1. Then, the gaseous refrigerant from the outlet chamber 15 is discharged, via the outlet flange 14*a*, into a condenser (not shown) in the refrigerating circuit.

During the compression operation of the gas in the compression chambers P, a compression pressure reaction force is generated on the movable scroll member 8, which is received by the front housing 2, via the pressure receiving portions 11*a* of the ring 11 which is in contact with the movable scroll member 8 at the movable-sided pressure receiving surface 8*d*, on one hand, and with the immovable-sided pressure receiving surface 2*a*, on the other hand.

During the compression operation of the refrigerant gas, a centrifugal force as generated by the orbital movement of the movable scroll member 8 causes its scroll wall 8*b* to be radially contacted with the scroll wall 1*b* of the stationary scroll member 1 at points as illustrated, for example by $P_1$ and $P_2$ in FIG. 5. These points of contact function to seal the compression chambers P, and are moved along the involute curve of the scroll wall 1*b* of the stationary scroll member 1 during the orbital movement of the movable scroll member. However, the points of the contact between the scroll walls 1*b* and 8*b* are slightly spaced from the designated involute curve due to errors inevitably caused when the parts are machined or when the parts are assembled. As a result, a relative radial movement of the scroll wall 8*b* of the movable scroll member 8 with respect to the scroll wall 1*b* of the stationary scroll member takes place. Such a relative movement can also take place due to liquid compression. A radial relative movement of the bushing 6 with respect to the eccentric shaft 5 is allowed within a limited range due to the provision of the slide surfaces 5*a* and 6*b* and the radial space 23. In view of this, a suitable lubrication is necessary to obtain a smooth radial movement especially at radial sliding surfaces 5*a* and 6*b* between the eccentric shaft 5 and the bushing 6, and sliding surfaces 3*c* and 6*c* between the large diameter portion 3*a* of the rotating shaft 3 and the bushing 6.

In order to fulfill the above requirement as to lubrication, according to the first embodiment, the first communication passageway 25 as the recess 21*b* (FIG. 3) is provided in the washer 21 to allow the radial gaps 23 to communicate with the axially confined space 24, and the second communication passageway 27 is provided in the bushing 6 to allow the radial chamber 23 to communicate with the crank chamber R, which construct the recirculation circuit for the gaseous lubricant, which is, in order, constructed by the crank chamber R, the gap $G_7$ in the second radial bearing unit 7, the annular gap 26, the space 24, the first communication passageway 25, the radial chamber 23, the second communication passageway 27, and the crank chamber R. During the orbital movement of the movable scroll member, the second communication passageway 25 also effects an orbital movement, which causes the gaseous refrigerant in the passageway 25 to be moved radially outwardly due to the centrifugal force. As a result, a flow of the gaseous refrigerant as shown by arrows $f_1$, $f_2$, $f_3$ and $f_4$ is generated in the recirculating circuit. As a result, a lubricant in a mist state is supplied not only to the bearing unit 7 but also to the sliding surfaces 5*a* and 6*b* between the eccentric shaft 5 and the bushing 6 as well as the sliding surfaces 3*c* and 6*c* between the large diameter portion 3*a* and the bushing 6, thereby obtaining a desired lubrication, thereby preventing the parts from being easily worn.

Figure 6:
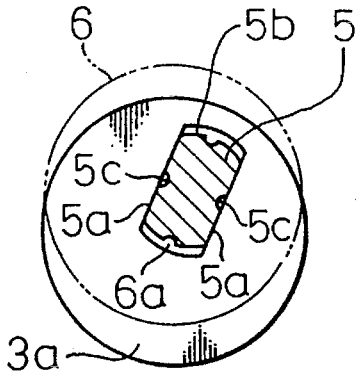
FIG. 6 shows a cross sectional view of a bushing in a modification.

The first embodiment can be modified as shown in FIG. 6, where the eccentric shaft 5 is formed with grooves 5*c* at its surfaces 5*a* contacting with the faced surfaces of the bore 6*a* of the bushing and at its surfaces 5*b* adjacent the radially confined spaces 23. These grooves 5*c* are effective for obtaining an increased flow of gas in the recirculation circuit, thereby enhancing the lubrication performance.

Figure 7:
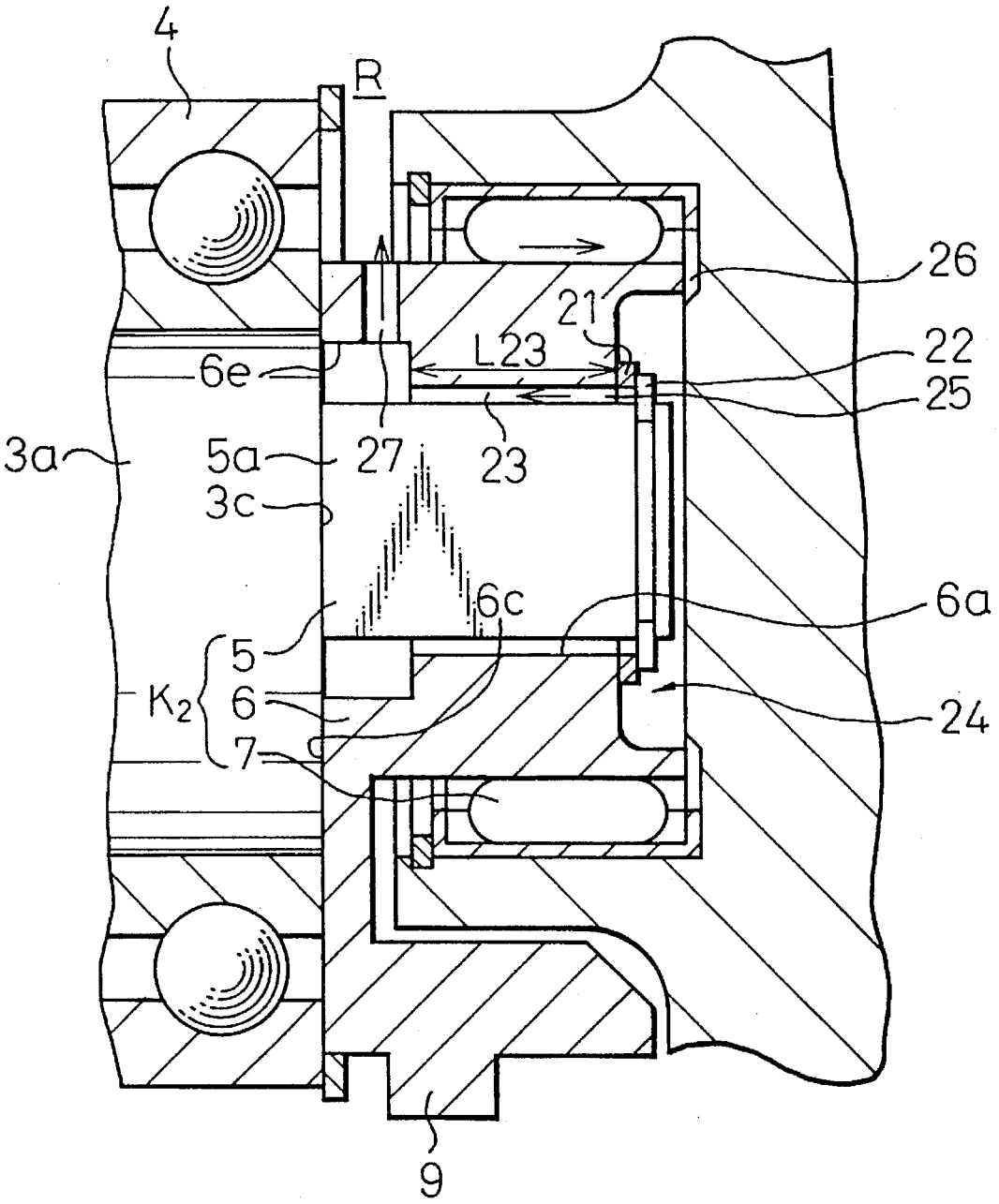
FIG. 7 is similar to FIG. 2, but illustrates a second embodiment of the present invention.
Figure 8:
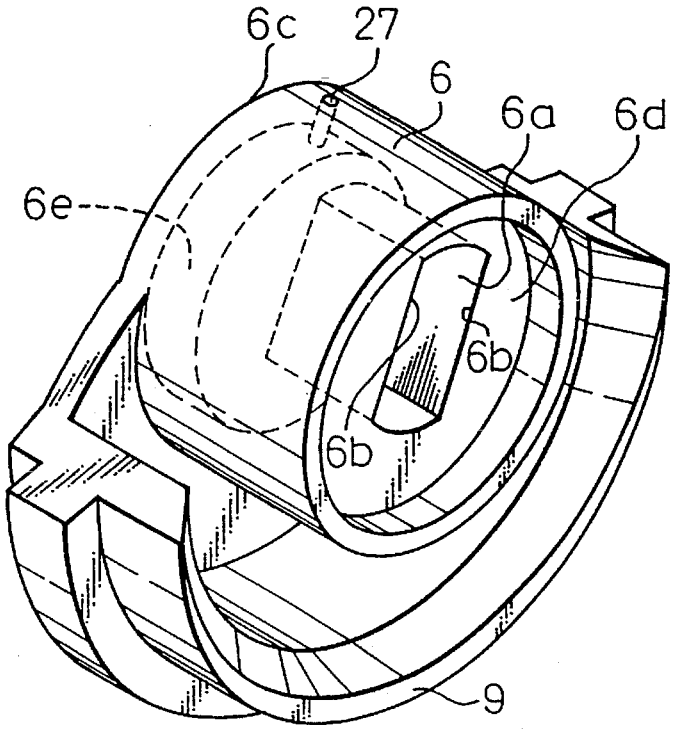
FIG. 8 is a perspective view of a bushing in FIG. 7.

FIGS. 7 and 8 show a second embodiment, where the bushing 6 is, at the front end surface 6*c*, formed with a circular cut-out portion 6*e*, which extends to the bore 6*a* for receiving the eccentric shaft 6*a*. The radial opening 27 (second communication passageway) is opened to the cut-out portion 6*e* at its inner cylindrical surface. Other constructions are the same as those for the first embodiment. In this second embodiment, the provision of the cut-out portion 6*e* at the front end surfaces 6*c* of the bushing 6 can reduce the axial length $L_{23}$ of the radial space 23 of the small effective area, as shown in FIG. 7. As a result, the recirculation of the gaseous refrigerant is promoted, thereby obtaining an improved lubrication between the sliding surfaces 5*a* and 6*b* and 3*c* and 6*c*. Thus, an enhanced durability of the crank mechanism $K_2$ can be obtained. Furthermore, the provision of the cut-out portion 6*e* at the front end surface 6*c* of the bushing 6 can reduce the area of the parallel sliding surfaces 6*b* of the bore 6*a*, thereby enhancing the productivity when the surfaces are machined.

Figure 9:
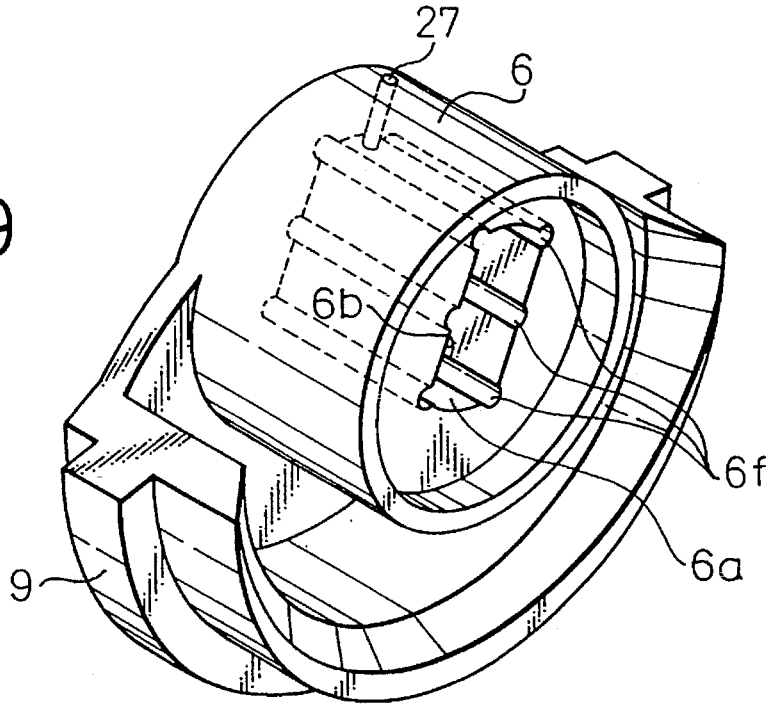
FIG. 9 is similar to FIG. 8, but illustrates a third embodiment.

FIG. 9 shows a third embodiment, where the bushing 6 is, at the bore 6*a* for receiving the eccentric shaft, formed with grooves 6*f* which extend axially. The grooves 6*f* are located at locations corresponding to ends of the sliding surfaces 6*b*, i.e., the corners in a rectangular cross sectional shape of the opening 6*b* and middle portions of the sliding surfaces 6*b*. Other constructions are the same as those for the first embodiment. The provision of the grooves 6*f* in the third embodiment can increase the volume of the radial spaces 23, thereby obtaining an increased amount of the gaseous lubricant. Thus, an improved lubrication is obtained, on one hand, and an enhancement of the durability of the crank mechanism $K_2$ is obtained, on the other hand.

Figure 10:
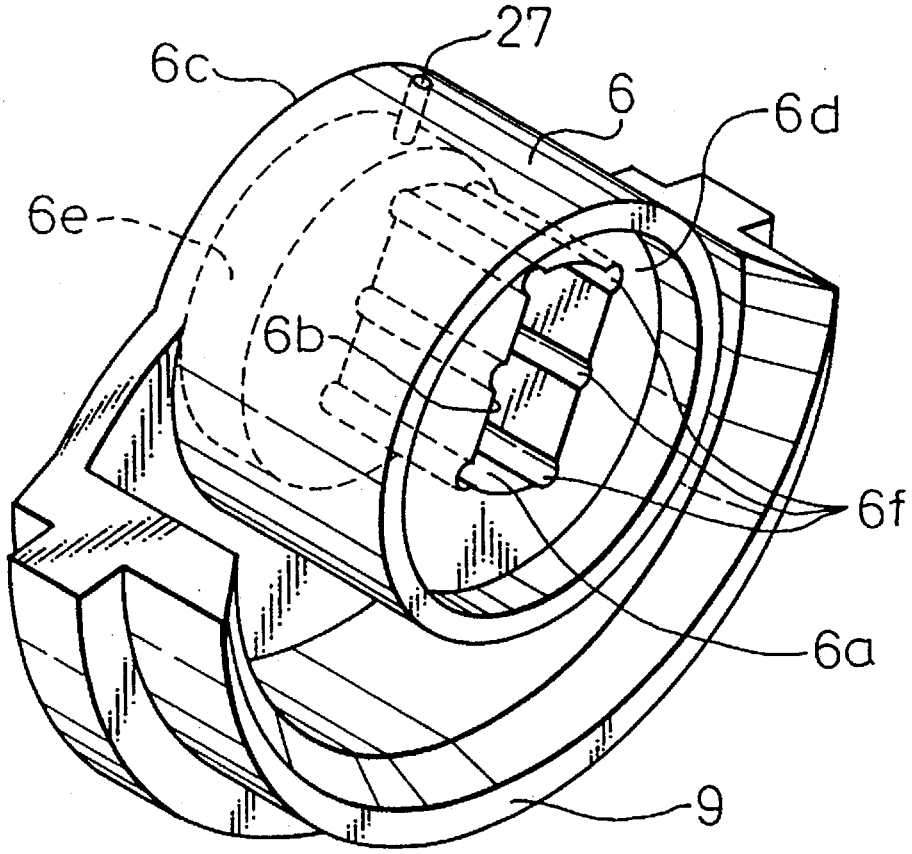
FIG. 10 is similar to FIG. 9, but illustrates a fourth embodiment.

FIG. 10 shows a fourth embodiment, where the cut-out portion 6*e* as the front end surface 6*c* of the bushing in the embodiment in FIGS. 7 and 8 and the grooves 6*f* in the embodiments in FIG. 9 are combined. The remaining construction is the same as that in the previous embodiments. The provision of both of the cut-out portion 6*e* and the grooves 6*f* can obtain both of an improved lubrication performance as well as the enhanced durability of the crank mechanism $K_2$.

Figure 11:
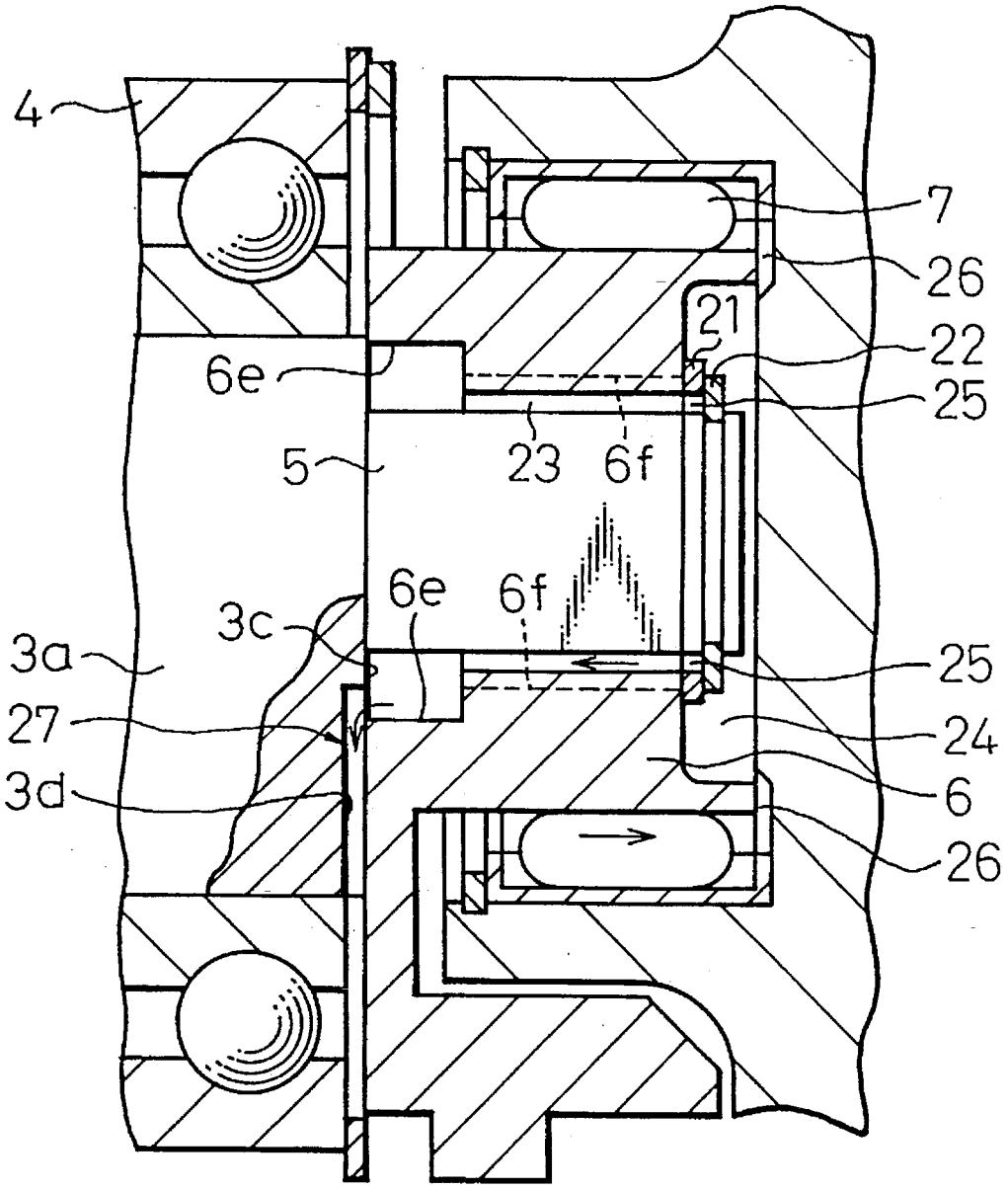
FIG. 11 is similar to FIG. 2, but illustrates a fifth embodiment of the present invention.
Figure 12:
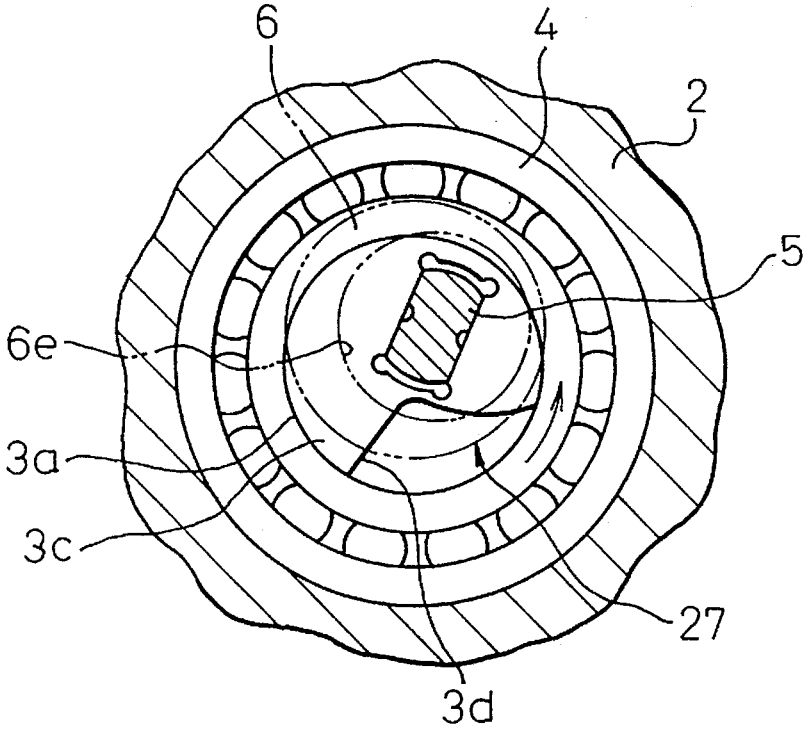
FIG. 12 is a cross sectional view of the bushing in FIG. 11.

FIGS. 11 and 12 illustrates a fifth embodiment, where in place of the second communication passageway 27 in the bushing 6 in the first embodiment, the large diameter portion 3*a* of the rotation shaft 3 is, at the rear end surface 3*c*, formed with a recess 3*d*. The recess 3*d* has an inner end which is in communication with the circular cut-out portion 6e (FIGS. 7 and 8) at the front end surface of the bushing 6 and an outer end opened to the outer cylindrical surface of the large diameter portion 3*a*. As shown in FIG. 12, the groove 3*d* is radially outwardly widened. As a result, a discharge of the gaseous refrigerant from the groove 6*e* to the crank chamber R under the effect of the centrifugal force is promoted by way of the groove 3*d*, thereby increasing the lubricating performance of the crank mechanism $K_2$.

Figure 13:
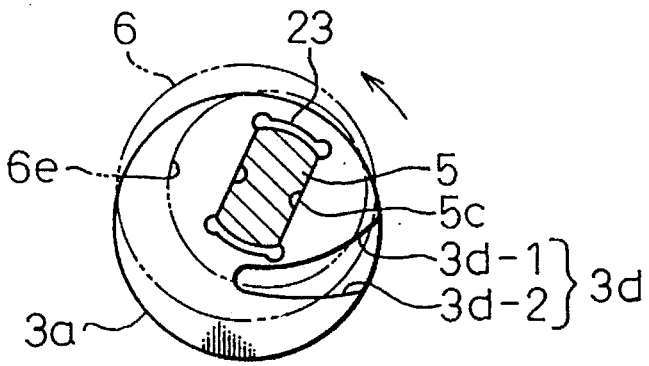
FIG. 13 is similar to FIG. 12 but illustrates a modification.

FIG. 13 shows a groove 3*d* which is modified so that it is formed with opposite edges 3*d*-1 and 3*d*-2, both of which are inclined forwardly in the direction of the rotation of the bushing 6 as shown by an arrow. As a result, the rotation of the bushing 6 causes the gas in the crank chamber R to be caught by the groove 3*d*, so that the gas in the crank chamber R is introduced into the space 23. In other words, a recirculated flow of the gas is obtained in a direction opposite to that as explained with respect to the embodiment in FIG. 2.

Figure 14:
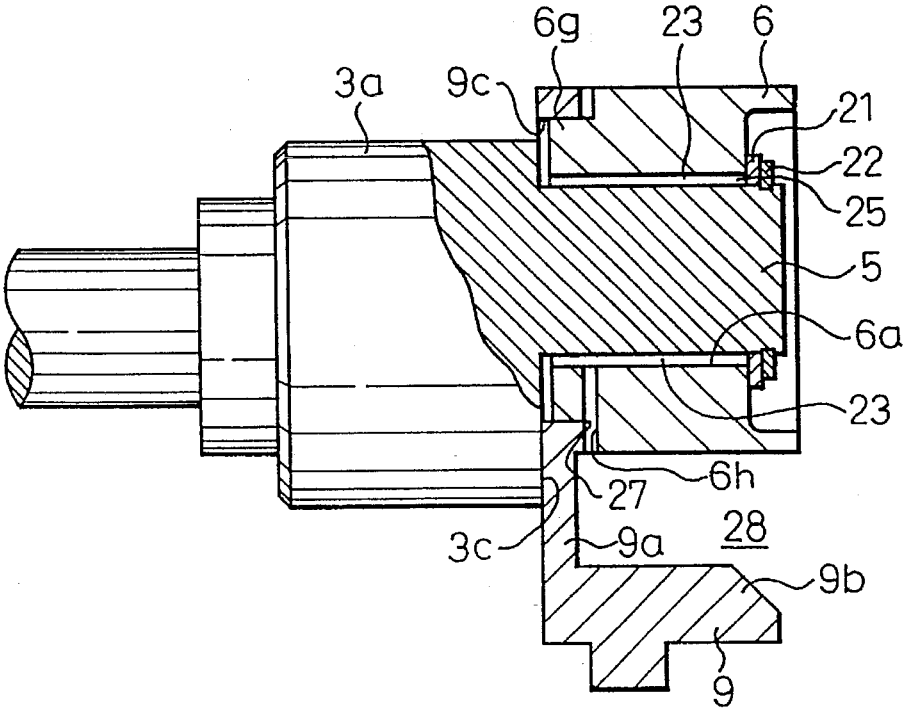
FIG. 14 is a partially sectioned side view of a shaft and a bushing in another embodiment.

FIG. 14 shows a sixth embodiment, where, in place of one piece structure of the bushing 6 with the weight 9 in the previous embodiment (FIG. 3), the weight 9 is separated from the bushing 6. Namely, in FIG. 14, the bushing 6 has a front portion 6*g* of a reduced diameter, while the weight member 9 is formed with an opening 9*c*, to which the reduced diameter portion 6*g* of the bushing is press fitted. The bushing 6 has, at its front end surface, a radial recess 6*h*, which functions as the second communication passageway for communicating the crank chamber R with the radially confined space 23 between the faced surfaces of the eccentric shaft 5 and the bore 6*a* of the bushing 6. In the embodiment, the gas flows in a space 28 between the outer surface of the bushing and the inner surface of the weight member 9*b*. Namely, the gas is discharged outwardly from the second passageway. Thus, the recirculation of the gas is promoted, thereby enhancing the lubrication performance at the crank mechanism $K_2$.

Figure 15:
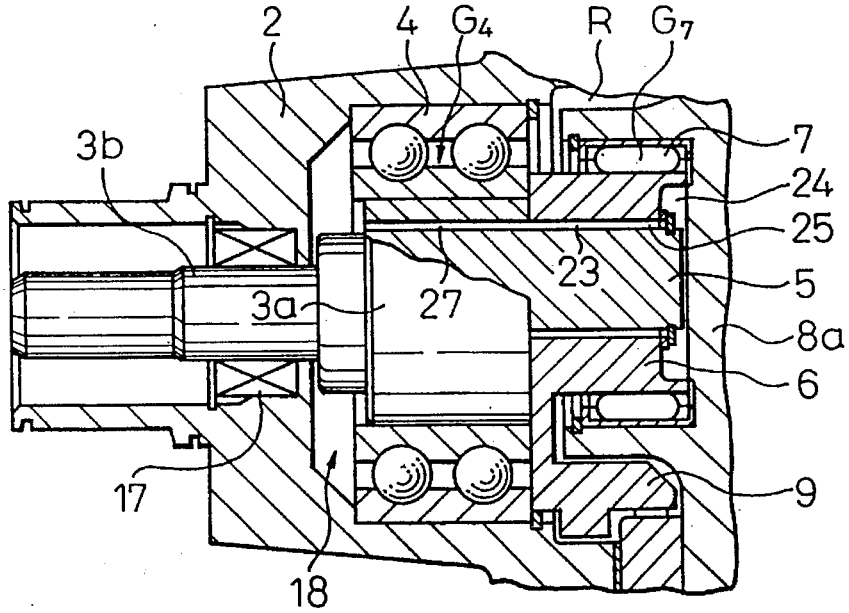
FIG. 15 is a longitudinal cross sectional view of a still another embodiment.

FIG. 15 is a seventh embodiment of the present invention, where the large diameter portion 3*a* of the shaft 3 has an axial bore therethrough, which functions as a second communication passageway 27 and which has one end opened to the radially confined space 23 and a second end opened to a front end surface of the large diameter portion 3*a* of the shaft 3. In this embodiment, a recirculation circuit for the gaseous lubricant is created, which is, in order, constructed by the crank chamber R, the gap $G_7$ in the second radial bearing unit 7, the axially confined space 24, the first communication passageway 25, the radial space 23, the second communication passageway 27, the seal chamber 18, the gap $G_4$ in the first radial bearing unit 4 and the crank chamber R. As a result, an improved lubrication is obtained not only for the crank mechanism $K_2$ but also for the bearing 4 and the shaft seal unit 17.

Figure 16:
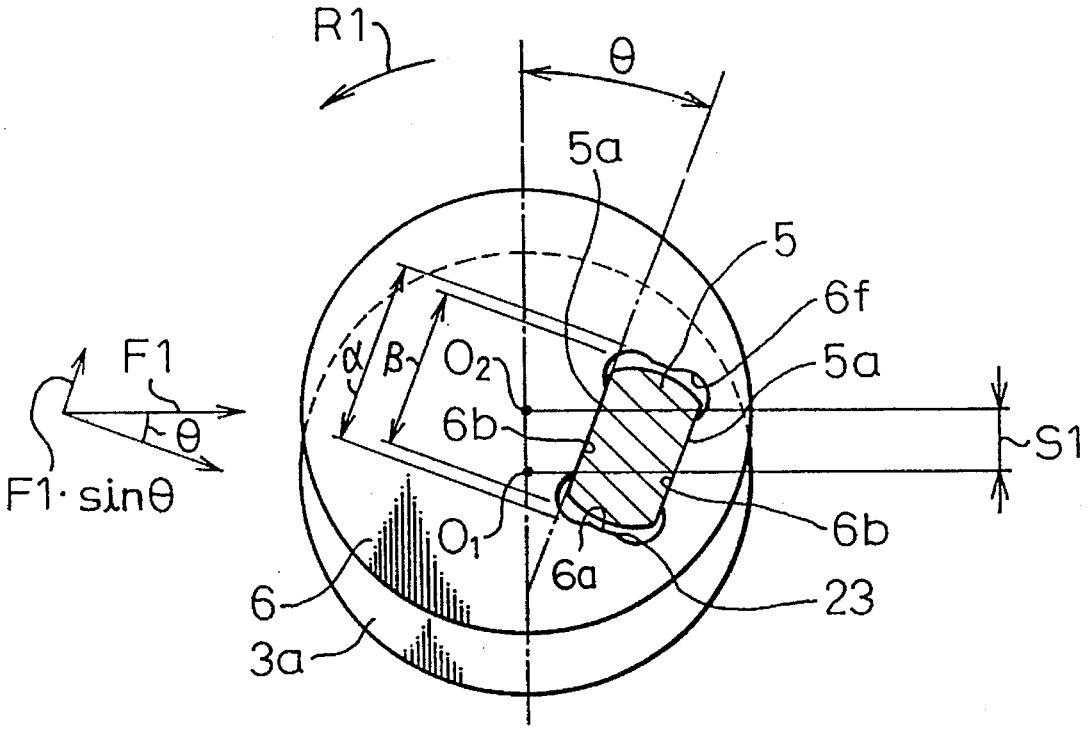
FIG. 16 shows another arrangement of an eccentric shaft with respect to a bushing.

Unlike the previous embodiments, where the eccentric shaft 5 is located on a diametric line of the bushing 6, in the embodiment shown by FIG. 16, the eccentric shaft 5 is located at a position spaced from the diametrical line of the bushing. However as similar to the previous embodiments, the pairs of load receiving surfaces 5*a* and 6*b* extend so as to be inclined at an angle with respect to the line connecting the axis $O_1$ of the orbital movement (axis of the shaft) and the axis $O_2$ of the bushing 6 in the direction opposite to the direction of the rotation of the bushing as shown by an arrow R1. As a result, a compression force F1 is generated at the axis $O_2$ of the bushing 6 in a radially outward direction. This force is received by the load receiving surfaces 5*a* and 6*b*, which are inclined with respect to the diametrical line connecting the axis $O_1$ of shaft and the axis $O_2$ of the bushing 6. Thus, in the direction parallel to the load receiving surfaces 5*a* and 6*b*, a force component $F1 \times \sin\theta$ is generated, which causes the movable and stationary scroll walls to maintain their radial contact.

Furthermore, in the embodiment in FIG. 16, the length $\alpha$ of the bore 6*a* is larger than the length $\beta$ of the eccentric shaft 5 for a value of 1 mm, and the width of the bore 6*a* is slightly larger than the width of the eccentric shaft 5 for a value of 10 μm. As a result, a smooth sliding movement of the eccentric shaft 5 in the bore 6*a* is obtained. As similar to the embodiment in FIG. 9, the bore 6*a* is formed with grooves 6*f* (FIG. 16) at the corners in the rectangular cross section of the bore 6*a*. As a result, an increased flow area in the space 23 is obtained.

We claim:

1. A scroll compressor for a gas including lubricant, comprising:

a housing;

a drive shaft having an axis for a rotation, the drive shaft having a first portion of a small diameter and a second portion of a large diameter;

a first radial bearing for supporting the drive shaft rotatably with respect to the housing;

a stationary scroll member which is in a fixed relationship with respect to the housing;

a movable scroll member arranged eccentric with respect to the stationary scroll member so that a plurality of compression chambers are created between the scroll members, said movable scroll member having a boss portion at a side opposite to said chambers;

an eccentric shaft connected to the drive shaft and eccentric with respect to the drive shaft;

a bushing having a bore of a substantially rectangular cross sectional shape, to which the eccentric shaft is inserted and is axially located in a fixed position, while the rotational movement of the shaft is transmitted to the bushing and the boss portion of the movable scroll member;

a second radial bearing housed in the boss portion of the movable scroll member for supporting the bushing rotatably with respect to the movable scroll member;

an axial space being formed between faced ends of the bushing and the boss portion of the movable scroll member, the axial space being in communication with the second radial bearing;

a self rotation blocking mechanism for the movable scroll member, which prevents the movable scroll member from being rotated about its own axis, so that the orbital movement of the movable scroll member allows the compression chambers to be moved radially from an outward position to an inward position;

an intake means for introducing the gas to be compressed into a compression chamber when it is located at a radially outward position;

an outlet means for discharging the gas as compressed when the compression chamber is located at a radially inward position;

the bore of the bushing defining spaced first inner surfaces, while the eccentric shaft defines spaced first outer surfaces, so that the inner surfaces contact with faced outer surfaces, which allows the rotating movement of the eccentric shaft to be transmitted to the bushing;

the bore further defining spaced second inner surfaces, while the eccentric shaft defining spaced second outer surfaces, so that radially confined spaces are created between faced second inner and outer surfaces, which allows the bushing, along said contacted first inner and outer surfaces, to be relatively radially moved and a first passageway for obtaining a communication between the radially confined spaces and said axially confined space, thereby obtaining a transmission of a lubricant between the spaces, wherein the bore of the bushing has, along its inner surface, at least one groove for increasing an amount of the flow of the lubricant in the radially confined spaces.

2. A scroll compressor according to claim 1, further comprising an annular member and a washer for determining the fixed axial position of the bushing on the eccentric shaft, said washer forming along its inner periphery at least a portion of the first passageway.

3. A scroll compressor according to claim 1, further comprising means forming a second passageway for obtaining a communication between the radially confined spaces and the intake means for creating a recirculation passageway for the lubricant.

4. A scroll compressor according to claim 3, wherein said bushing has, on its end surface facing the large diameter portion of the shaft, a cut-out portion to which both of the radially confined spaces and the second passageway are opened.

5. A scroll compressor according to claim 3, wherein said large diameter portion has, on its surface facing the bushing, a radially extending surface formed with a recess having a first end opened to the radially confined spaces and a second end opened to the intake means, said radial recess forming the second passageway.

6. A scroll compressor for a gas including lubricant, comprising:

a housing;

a drive shaft having an axis for a rotation, the drive shaft having a first portion of a small diameter and a second portion of a large diameter;

a first radial bearing for supporting the drive shaft rotatably with respect to the housing;

a stationary scroll member which is in a fixed relationship with respect to the housing;

a movable scroll member arranged eccentric with respect to the stationary scroll member so that a plurality of compression chambers are created between the scroll members, said movable scroll member having a boss portion at a side opposite to said chambers;

an eccentric shaft connected to the drive shaft and eccentric with respect to the drive shaft;

a bushing having a bore of a substantially rectangular cross sectional shape, to which the eccentric shaft is inserted and is axially located in a fixed position, while the rotational movement of the shaft is transmitted to the bushing and the boss portion of the movable scroll member;

a second radial bearing housed in the boss portion of the movable scroll member for supporting the bushing rotatably with respect to the movable scroll member;

an axial space being formed between faced ends of the bushing and the boss portion of the movable scroll member, the axial space being in communication with the second radial bearing;

a self rotation blocking mechanism for the movable scroll member, which prevents the movable scroll member from being rotated about its own axis, so that the orbital movement of the movable scroll member allows the compression chambers to be moved radially from an outward position to an inward position;

an intake means for introducing the gas to be compressed into a compression chamber when it is located at a radially outward position;

an outlet means for discharging the gas as compressed when the compression chamber is located at a radially inward position;

the bore of the bushing defining spaced first inner surfaces, while the eccentric shaft defines spaced first outer surfaces, so that the inner surfaces contact with faced outer surfaces, which allows the rotating movement of the eccentric shaft to be transmitted to the bushing;

the bore further defining spaced second inner surfaces, while the eccentric shaft defining spaced second outer surfaces, so that radially confined spaces are created between faced second inner and outer surfaces, which allows the bushing, along said contacted first inner and outer surfaces, to be relatively radially moved;

means defining a first passageway for obtaining a communication between the radially confined spaces and said axially confined space, thereby obtaining a transmission of a lubricant between the spaces; and means defining a second passageway for obtaining a communication between the radially confined spaces and the intake means for creating a recirculation passageway for the lubricant;

wherein said bushing has, on its end surface facing the large diameter portion of the shaft, a cut-out portion to which both of the radially confined spaces and the second passageway are opened.

7. A scroll compressor for a gas including lubricant, comprising:

a housing;

a drive shaft having an axis for a rotation, the drive shaft having a first portion of a small diameter and a second portion of a large diameter;

a first radial bearing for supporting the drive shaft rotatably with respect to the housing;

a stationary scroll member which is in a fixed relationship with respect to the housing;

a movable scroll member arranged eccentric with respect to the stationary scroll member so that a plurality of compression chambers are created between the scroll members, said movable scroll member having a boss portion at a side opposite to said chambers;

an eccentric shaft connected to the drive shaft and eccentric with respect to the drive shaft;

a bushing having a bore of a substantially rectangular cross sectional shape, to which the eccentric shaft is inserted and is axially located in a fixed position, while the rotational movement of the shaft is transmitted to the bushing and the boss portion of the movable scroll member;

a second radial bearing housed in the boss portion of the movable scroll member for supporting the bushing rotatably with respect to the movable scroll member;

an axial space being formed between faced ends of the bushing and the boss portion of the movable scroll member, the axial space being in communication with the second radial bearing;

a self rotation blocking mechanism for the movable scroll member, which prevents the movable scroll member from being rotated about its own axis, so that the orbital movement of the movable scroll member allows the compression chambers to be moved radially from an outward position to an inward position;

an intake means for introducing the gas to be compressed into a compression chamber when it is located at a radially outward position;

an outlet means for discharging the gas as compressed when the compression chamber is located at a radially inward position;

the bore of the bushing defining spaced first inner surfaces, while the eccentric shaft defines spaced first outer surfaces, so that the inner surfaces contact with faced outer surfaces, which allows the rotating movement of the eccentric shaft to be transmitted to the bushing;

the bore further defining spaced second inner surfaces, while the eccentric shaft defining spaced second outer surfaces, so that radially confined spaces are created between faced second inner and outer surfaces, which allows the bushing, along said contacted first inner and outer surfaces, to be relatively radially moved; and means forming a first passageway for obtaining a communication between the radially confined spaces and said axially confined space, thereby obtaining a transmission of a lubricant between the spaces; and means forming a second passageway for obtaining a communication between the radially confined spaces and the intake means for creating a recirculation passageway for the lubricant;

wherein said large diameter portion has, on its surface facing the bushing, a radially extending surface formed with a recess having a first end opened to the radially confined spaces and a second end opened to the intake means, said radial recess forming the second passageway.

* * * * *